US005199187A

United States Patent [19]

Sutherland

[11] Patent Number: 5,199,187

[45] Date of Patent: Apr. 6, 1993

[54] FREEZE DRYER APPARATUS HAVING AN INTERIM CONDENSING SYSTEM AND USE THEREOF

[75] Inventor: David T. Sutherland, Kingston, N.Y.

[73] Assignee: SP Industries, Miami, Fla.

[21] Appl. No.: 738,785

[22] Filed: Jul. 31, 1991

[51] Int. Cl.[5] ..... F26B 5/06

[52] U.S. Cl. ..... 34/92; 34/5; 62/268

[58] Field of Search ..... 34/5, 92; 62/55.5, 268

[56] References Cited

U.S. PATENT DOCUMENTS

| | | | |
|---|---|---|---|
| 2,561,305 | 7/1951 | Limpert et al. | 62/117.25 |
| 3,178,829 | 4/1965 | Cox | 34/5 |
| 3,271,874 | 9/1966 | Oppenheimer | 34/5 |
| 3,382,586 | 5/1968 | Lorentzen | 34/5 X |
| 3,516,170 | 6/1970 | Liobis et al. | 34/92 X |
| 4,191,024 | 3/1980 | Machida | 62/80 |
| 4,749,394 | 6/1988 | Ehrsam | 62/532 |
| 4,751,828 | 6/1988 | Coulter et al. | 62/514 |
| 4,823,478 | 4/1989 | Thompson, Sr. | 34/5 |
| 4,949,473 | 8/1990 | Steinkamp | 34/92 |

OTHER PUBLICATIONS

Northstar Product Literature, prior to Jul. 31, 1991.

*Primary Examiner*—Stephen M. Hepperle

*Attorney, Agent, or Firm*—Heslin & Rothenberg

[57] ABSTRACT

The subject invention provides a freeze dryer apparatus having an interim condensing system, preferably a refrigeratable condensing surface. The interim condensing system condenses vapors within the product chamber of the freeze dryer apparatus when the main condenser coil, which normally condenses vapors within the product chamber, needs to be defrosted. The refrigeratable condensing surface is preferably mounted inside the product chamber.

5 Claims, 1 Drawing Sheet

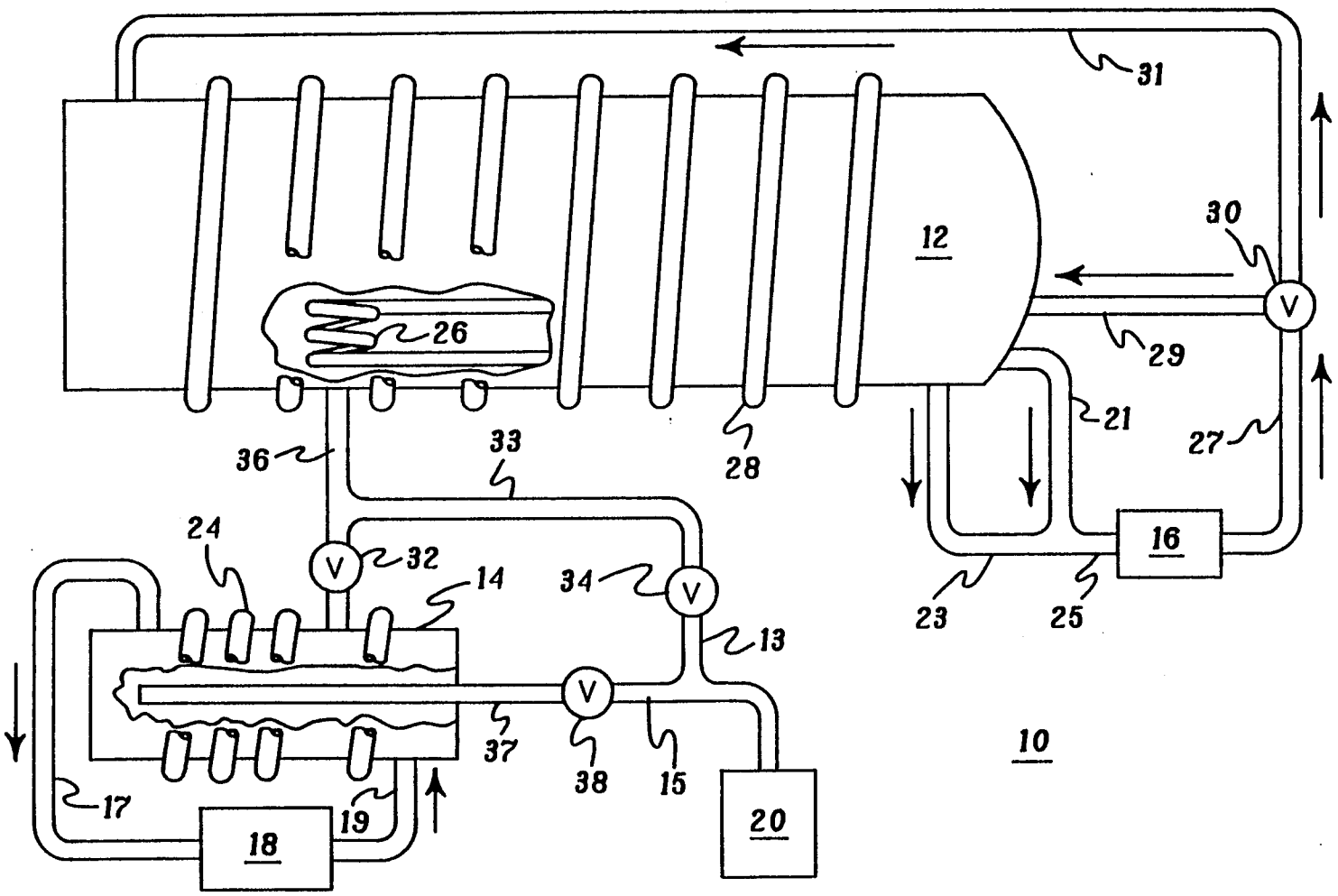
10
12
13
14
15
16
17
18
19
20
21
23
24
25
26
27
28
29
30
31
32
33
34
36
37
38

FREEZE DRYER APPARATUS HAVING AN INTERIM CONDENSING SYSTEM AND USE THEREOF

BACKGROUND OF THE INVENTION

1. Technical Field

This invention relates to a freeze dryer apparatus and more particularly to a freeze dryer apparatus having an interim condensing system. The interim condensing system condenses vapors within the product chamber of the freeze dryer apparatus when the main condenser, which normally condenses the vapors from within the product chamber, needs to be defrosted.

2. Description of the Prior Art

Freeze drying, called sublimation or lyophilization, is a dehydration process accomplished under precisely controlled conditions. Freeze drying causes the ice within a specimen to change from a solid directly into a gaseous/vapor state, bypassing the liquid state altogether. Unlike specimens dried from the usual non-frozen condition, freeze-dried specimens do not distort nor shrink. Applied to the taxidermy field, the result is a truly lifelike specimen, which is the goal of all taxidermists and museum curators.

Sublimation begins at the outer surface of the specimen and recedes towards the center of the specimen as drying advances. As ice molecules change to a vapor state, they are carried away from the specimen by lower pressure elsewhere. This lower pressure region is the ice condenser. Most specimens are dried by using a surrounding product chamber temperature of −5° F. (about −20° C.). The refrigerated condenser, typically running at −60° F. (about −51° C.), presents substantially lower vapor pressure which causes a migration of the vapor from the −5° F. (about −20° C.) product chamber to the −60° F. (about −51° C.) condenser region. A vacuum system is also provided which removes almost all of the air from the product chamber and condenser, allowing the ice/vapor molecules to move unhampered to the condenser.

Typically, freeze dryer apparatuses have an external condenser. After a period of use, the continuous condensation of the vapors at the condenser causes ice to build up on the condenser. Therefore, the condenser must be defrosted, drained, and recooled in order to continue to function properly. This process, typically taking ten (10) to thirty (30) minutes, results in a problem in that the product chamber is closed off to any form of condensing during the defrost period. During this off period in freeze driers, the pressure in the product chamber invariably rises due to water vapor still being evolved from the frozen samples with no condensing capability being available.

This pressure rise in turn causes the sample temperature to rise, possibly resulting in melting of the samples and thus a partial or complete loss of freeze drying benefits. Secondarily, when the defrosted condenser is finally returned to duty, it is subjected to a very high loading due to the accumulated vapor and higher sample temperatures.

Attempts have been made to solve this problem by creating specimen dryers with two (2) or more equal sized external condensers, with either a common or independent refrigeration system. These systems are capable of continuous freeze drying. However, these systems are expensive in terms of the substantial cost of this second external condenser.

Steinkamp, U.S. Pat. No. 4,949,473, issued Aug. 21, 1990, discloses a freeze drying apparatus which includes two condensers. The second condenser serves as a fail-safe condensation means in the event of an apparatus malfunction in the primary condenser.

Northstar (Nisswa, MN) markets portable freeze dryer systems. One, the model L-48104 processor, has twin vacuum pumps and dual condensers. The dual condensers are both full size external condensers, and each may be connected to its own refrigeration system. The freeze dryer system includes isolation valves which allow for a defrost cycle at any time without interrupting the drying process, thus allowing for continuous operation.

However, the problems discussed above in regard to the advantages of eliminating two equal-sized external condensers are applicable to this Northstar system.

It is thus an object of the subject invention to provide a freeze dryer apparatus which provides continuous freeze drying without the need of a second external condenser to replace the main condenser while it is being thawed.

SUMMARY OF THE INVENTION

The subject invention solves these problems by providing a condenser system having an interim condensing system for use during defrosting of the main condenser chamber. The interim condensing system has a refrigeratable condensing surface, preferably a relatively small holding refrigeration coil mounted inside the product chamber, in addition to the standard external condenser. This second condenser allows freeze drying to continue while the external condenser is being defrosted. This effectively eliminates the problem time associated with previous freeze dryers and provides an extremely economical alternative to a second external condenser of equal size to the primary condenser. A further advantage of the internal second condenser is that it is housed within the already existing main product chamber and can utilize the same refrigeration system that refrigerates the single external condenser, or it can utilized the chamber refrigeration system.

The second condenser coil can be very small and inexpensive. It need only be adequate in size to accumulate ice for the short thirty (30) minute defrost period. The freeze dryer system of the subject invention can be beneficial just as described or further enhanced by providing a secondary vacuum line to allow a vacuum pump to continue pumping the main chamber during the defrost cycle. Variations also include a separate refrigeration system for the second condenser coil. A hot gas defrost system to defrost the main condenser can also be utilized while the second condenser coil is in operation. A second small vacuum pump can also be employed with the second condenser coil.

When defrost is complete and the main external condenser is reconnected, the second coil will no longer be cooled. Since it is mounted inside the product chamber, the ice accumulated on the coil will slowly warm and migrate to the main condenser at a slow rate, which can be handled without the disruption or overload associated with defrost.

In effect, a form of continuous freeze drying is thus provided. This solves the long standing problem, associated particularly with specimen freeze dryers where the cycles take days, weeks and months, wherein it is not economically feasible to size the condenser to hold the entire moisture load as is done in the single batch concept associated with pharmaceutical or food freezed drying. The subject invention also solves the long standing problem of specimen thawing during defrosting, as well as the expense associated with equal-sized second external condensers.

BRIEF DESCRIPTION OF THE DRAWINGS

These and other objects, advantages and features of the present invention will be more fully understood from the following detailed description of certain embodiments thereof when considered in conjunction with the accompanying drawing in which:

FIG. 1 illustrates one embodiment of the subject invention in which a relatively small holding refrigeration coil is located within the product chamber.

DETAILED DESCRIPTION OF THE INVENTION

The subject invention provides a freeze dryer apparatus (10) as shown in FIG. 1, in which a relatively small internal condenser coil (26) is located inside a product chamber (12). This internal condenser (26) is connected directly to the chamber refrigerator (16) provided for the product chamber (12). Alternatively, the interior condenser could be connected to the condenser refrigerator (18), or to its own refrigeration unit.

The small internal condenser (26) is located at the communication channel (36) between the product chamber (12) and condenser chamber (14). A vacuum pump (20) is connected directly to the condenser chamber (14) via vacuum line (37) having a valve (38) therein and is also connected directly to the product chamber (12) by connection to the communication channel (36) via vacuum line (33) having a valve (34) therein.

Alternatively, a freeze dryer apparatus could have a small internal condenser located where a second communication channel connects to the product chamber. In this case, the vacuum pump is connected directly to the condenser chamber via a valve and also directly to the product chamber via a second communication channel and valve. It is also possible to provide two vacuum pumps with a separate vacuum pump for the small condenser. Then the small condensing coil would be connected by way of a communication channel to its own vacuum pump via a valve. The first vacuum pump would be connected to the condenser chamber which would be in communication with the product chamber by way of the communication channel and valve. Two vacuum pumps may also be used in which the small internal condenser would be placed at the location where the communication channel contacts the product chamber. The first vacuum pump would be connected to the condenser chamber which would be in communication with the product chamber via the communication channel and valve. The second vacuum pump would be connected directly to the communication channel via another valve.

In this preferred embodiment as depicted in FIG. 1, the small internal condenser (26) provides for condensation of vapors in the product chamber (12) while the large external condenser (14) is being thawed.

In standard operation, the large external condenser (14) provides for condensation of vapors in the product chamber (12). The large external condenser (14) is connected to a condenser refrigerator (18) by lines (17) and (19) which communicate with a refrigeration coil (24) surrounding the large external condenser (14). A vacuum pump (20) is connected to the large external condenser (14) via lines (15) and (37) having a valve (38) therebetween. The product chamber (12) is in communication with the large external condenser (14) via communication channel (36) also having a valve (32) therein. The product chamber (12) is connected to a chamber refrigerator (16) by lines (27), (31), (23) and (25) which communicate with a refrigeration coil (28) surrounding the product chamber (12). Lines (27) and (31) are connected by a three-way valve (30).

To provide for condensation of vapors within the product chamber (12) using the large external condenser (14), the condenser refrigerator (18) is in operation as well as the vacuum pump (20) and the chamber refrigerator (16). Valves (38) and (32) are open, and valve (34) is closed. This provides for communication between the vacuum pump (20) and the large external condenser (14), which is in turn in communication with the product chamber (12) via communication channel (36). The product chamber (12) is refrigerated by opening valve (30) so that refrigerant from the chamber refrigerator (16) flows through line (27) to valve (30) to line (31). Line (31) allows refrigerant to flow through refrigeration coil (28), after which it returns to the chamber refrigerator (16) by lines (23) and (25).

In order to defrost the large external condenser (14), valve (30) is positioned so that refrigerant from the chamber refrigerator (16) flows through line (27) to valve (30) and to line (29). Line (29) allows the refrigerant to flow through the small internal condenser coil (26), after which the refrigerant returns to the chamber refrigerator (16) by lines (21) and (25). When the small internal condenser coil (26) has reached the correct temperature so that it will condense vapors within the product chamber (12), the condenser refrigerator (18) is turned off. Valves (32) and (38) are closed and valve (34) is opened. This allows the vacuum pump (20) to bypass the large external condenser (14) and communicate directly with the communication channel (36) via lines (13) and (33) having valve (34) therebetween.

When the large external condenser (14) is defrosted, the condenser refrigerator (18) is turned back on and the large external condenser (14) is allowed to reach the correct temperature to condense vapors within the product chamber (12). At that time, valve (34) is closed and valves (32) and (38) are reopened. This results in the large external condenser (14) again being connected to provide for condensation, so valve (30) is positioned so that refrigerant does not flow through line (29) to the small internal condenser coil (26). Ice which has accumulated on coil (26) will now be sublimated and collected in condenser chamber (14) along with ice sublimated from the specimen in product chamber (12).

This operation of the freeze dryer apparatus (10) prevents any lag time when either the small internal condenser coil (26) or the large external condenser (14) are being brought up to the correct temperature for condensing vapors.

EXAMPLE 1

A product chamber 36 inches in diameter and 66 inches long was designed to freeze dry specimens. The product chamber was refrigerated using a chamber refrigerator so that its temperature was kept at approximately −5° F. (about −20° C.). A communication channel connected the product chamber to an external condenser chamber. The external condenser chamber was surrounded by an external condensing coil connected to the condenser refrigerator. The temperature in the condenser chamber was maintained at about −60° F. (about −51° C.). This condenser chamber was connected to the product chamber via a valve. A vacuum pump was connected to the condenser chamber via a valve and also to the communication channel via a separate valve.

The interim condensing system comprised a refrigeratable condensing surface which was a ⅜ inch tubular stainless steel coil, 3 to 4 feet in length if stretched out. Suitable refrigeration plates could be used in place of this tubular stainless steel coil. The tubular stainless steel coil was positioned within the product chamber at the position where the communication channel entered the product chamber.

The external condenser has a maximum capacity for removing about 50 pounds of water, approximately 24 liters, before ice accumulates to a point where the external condenser must be defrosted. The rate at which water vapor is removed from the product chamber and deposited as ice in the external condenser is about 40 pounds of water per 72 hours, or about ½ pound per hour. The holding coil, which is the tubular stainless steel coil, can remove water and, thus, accumulate ice at the same rate. However, because of its small size, it can only operate at this efficiency for approximately 30 minutes, which is sufficient time for the external condenser to be defrosted. Therefore, the holding coil is in operation for approximately 30 minutes in which time approximately ¼ pound of water is processed.

While the holding coil is in operation, the external condenser is defrosted, preferably by running hot gas through it. An electrical heater could also be used.

By connecting the internal condenser to the chamber refrigerator as its refrigeration source, the most efficient defrost and operational cycles can be obtained. For example, if it takes five minutes in order to reach the proper operational temperature for the internal condenser, five minutes before the main external condenser is going to be defrosted, i.e. turned off, refrigeration of the internal condenser coil is begun. That way, when the main external condenser is defrosted there is no lag time between the condensing by the main external condenser and the small internal coil.

Likewise, when the main external condenser has been defrosted, the condenser refrigerator can be turned on to bring the main external condenser to its correct operational temperature for condensing prior to disconnecting the product chamber refrigerator from the small internal coil. This will allow the small internal coil to continue condensing vapors until the condenser chamber reaches the appropriate temperature for condensing those vapors.

Through continuous use of the freeze dryer for freeze drying these same types of specimens, one can become familiar with the cycle of the freeze dryer and how long it takes for enough ice to accumulate on the external condenser to require defrosting. After such a pattern has been established, an adjustable timer can be used to indicate when the external condenser should be defrosted. Microprocessors could also be used to automate the defrost cycle so that if, for example, ice was known to build up at 2 days, the freeze dryer could be set to defrost at 1 and ¾ days.

Typically, in the food or pharmaceutical industry defrosting is done when ice reaches ¾ to ⅞ of an inch on the external condenser. In the taxidermy field, because the freeze drying process is so slow, the ice can accumulate to 3–4 inches before defrosting is necessary. Normally this process takes about three days before the ice accumulation requires defrosting.

Although certain preferred embodiments have been depicted and described in detail herein, it will be apparent to those skilled in the relevant art that various modifications, additions, substitutions and the like can be made without departing from the spirit of the invention and these are therefore considered to be within the scope of the invention as defined by the appended claims.

What is claimed is:

1. A freeze dryer apparatus comprising:

a refrigeratable product chamber having a single cavity therein;

a refrigeratable condenser chamber exterior to said refrigeratable product chamber connected through a valve to a vacuum source and communicating through a channel with the product chamber, said channel having a valve therein, said condenser chamber being operable in a condensing mode for condensing thereon into ice relatively large amounts of water vapor migrating thereto from the product chamber and operable in a defrost mode for defrosting said condenser chamber;

valve means for directly connecting the product chamber to a vacuum source; and an interim condensing system for use during defrost mode operation of the condenser chamber, said system having a refrigeratable condensing surface positioned within said single central cavity of said refrigeratable product chamber for condensing water vapor migrating from the product chamber toward the vacuum source when the valve means is positioned so as to directly connect the product chamber and the vacuum source and also positioned to be defrosted during condensing mode operation of the condenser chamber, said interim condensing system being operable in a condensing mode for condensing water vapor into ice on its condensing surface and operable in a defrost mode for allowing ice to be defrosted therefrom;

wherein when said refrigeratable condenser chamber is operating in a condensing mode and said interim condensing system is operating in a defrost mode, water vapor generated by said defrost mode of said interim condensing system condenses into ice onto said refrigeratable condenser chamber.

2. The freeze dryer apparatus of claim 1 wherein the refrigeratable condensing surface comprises a coil.

3. The freeze dryer apparatus of claim 1 wherein the refrigeratable product chamber is associated with a first refrigeration means, the refrigeratable condenser chamber is associated with a second refrigeration means, and the refrigeratable condensing surface is refrigerated during condensing mode operation of the interim condensing system by the first refrigeration means.

4. The freeze dryer apparatus of claim 1 wherein the refrigeratable condensing surface is positioned over the location of the channel's entry to the product chamber.

5. The freeze dryer apparatus of claim 1 wherein the interim condensing system is operated at an optimum condensing temperature before the refrigeratable condenser chamber is operated in a defrost mode.

* * * * *